US005482263A

United States Patent [19]

Kutzleb

[11] Patent Number: 5,482,263

[45] Date of Patent: Jan. 9, 1996

[54] ANGLE ADJUSTABLE CLAMPS

[76] Inventor: Kurt Kutzleb, 54 Wasinger Dr., Bayfield, Colo. 81122

[21] Appl. No.: 184,653

[22] Filed: Jan. 21, 1994

[51] Int. Cl.[6] ..... B25B 1/00

[52] U.S. Cl. ..... 269/6; 269/37; 269/41; 269/258; 269/269; 269/228; 269/902

[58] Field of Search ..... 269/3, 6, 37, 41, 269/43, 258, 265–270, 228, 902; 81/367, 368, 370, 371, 420, 424, 418; 29/268, 281.1

[56] References Cited

U.S. PATENT DOCUMENTS

| | | | |
|---|---|---|---|
| 2,731,932 | 1/1956 | Petersen | 269/269 |
| 4,378,937 | 4/1983 | Dearman | 269/6 |
| 4,673,174 | 6/1987 | Tabbert | 269/258 |
| 4,696,460 | 9/1987 | Genereaux et al. | 269/6 |
| 4,725,049 | 2/1988 | Cantarinhas | 269/269 |
| 4,747,588 | 5/1988 | Dillhoff | 269/6 |

*Primary Examiner*—Robert C. Watson
*Attorney, Agent, or Firm*—Dean P. Edmundson

[57] ABSTRACT

Angle adjustable clamps are described which include a pair of jaws connected to pliers-type handles. At least one of the jaws includes two faces, and the angle between the faces is adjustable. The clamps are useful for gripping and supporting workpieces at a desired angle to each other.

8 Claims, 12 Drawing Sheets

ANGLE ADJUSTABLE CLAMPS

FIELD OF THE INVENTION

This invention relates to clamps and locking pliers. More particularly, this invention relates to adjustable clamps.

BACKGROUND OF THE INVENTION

Clamps various types have been used for a very long time and for a wide variety of purposes. See, for example, U.S. Pat. Nos. 2,731,932; 2,815,728; 3,617,044; 4,300,754; 4,386,543; 4,5050,011; 4,717,131; and 4,725,049. However, all of such clamps have fixed, non-adjustable jaws. In other words, such prior clamps include jaws which do not adjust or change shape so as to enable the clamp to conform to the shape of the item to be secured.

There has not heretofore been provided a clamp which includes angle-adjustable jaws.

SUMMARY OF THE INVENTION

In accordance with the present invention there is provided an adjustable clamp comprising adjustable angle jaw members. In one embodiment the clamp comprises:

(a) a handle portion; and (b) a clamp portion connected to the handle portion. The clamping portion comprises first and second jaw members, and at least one of the jaw members includes two faces. The angle between the faces is adjustable. The jaw members are movable by the handle between open and closed positions.

The shape of the jaw members may vary, as desired. For example, one of the jaw members may be U-shaped, or curved, or any other desired shape.

Because at least one of the jaw members includes two adjustable faces, the clamp can be effectively and simply used to hold workpieces of various different shapes in any desired position. For example, the clamp can be used to hold and support two metal or wood workpieces at a desired angle to each other so that the two workpieces can be joined together. This is especially useful when holding two items which are to be joined (e.g., welded) together at an angle. The clamp is able to hold the two items together firmly and securely so that the items do not shift position while they are being joined together.

The two faces of the adjustable jaw member may have any desired configuration. The two faces of the adjustable jaw members oppose each other in a way as to hold the material securely.

In another embodiment, both of the jaw members include adjustable angle faces. In this embodiment the corresponding faces on the upper and lower jaw members are preferably parallel to each other at all times. In other words, when the angle between the faces of the lower jaw member is changed, the angle between the faces of the upper jaw member is changed to the same extent.

The clamps of the invention include handles which enables the jaw members to be locked in their closed position. In other words, all of the clamps are of the locking plier type.

Other advantages of the adjustable angle clamps of the invention will be apparent from the following detailed description and the accompanying drawings.

BRIEF DESCRIPTION OF THE DRAWINGS

This invention is described in more detail hereinafter with reference to the accompanying drawings, wherein like reference characters refer to the same parts throughout the several views and in which.

DETAILED DESCRIPTION OF THE INVENTION

Figure 1:
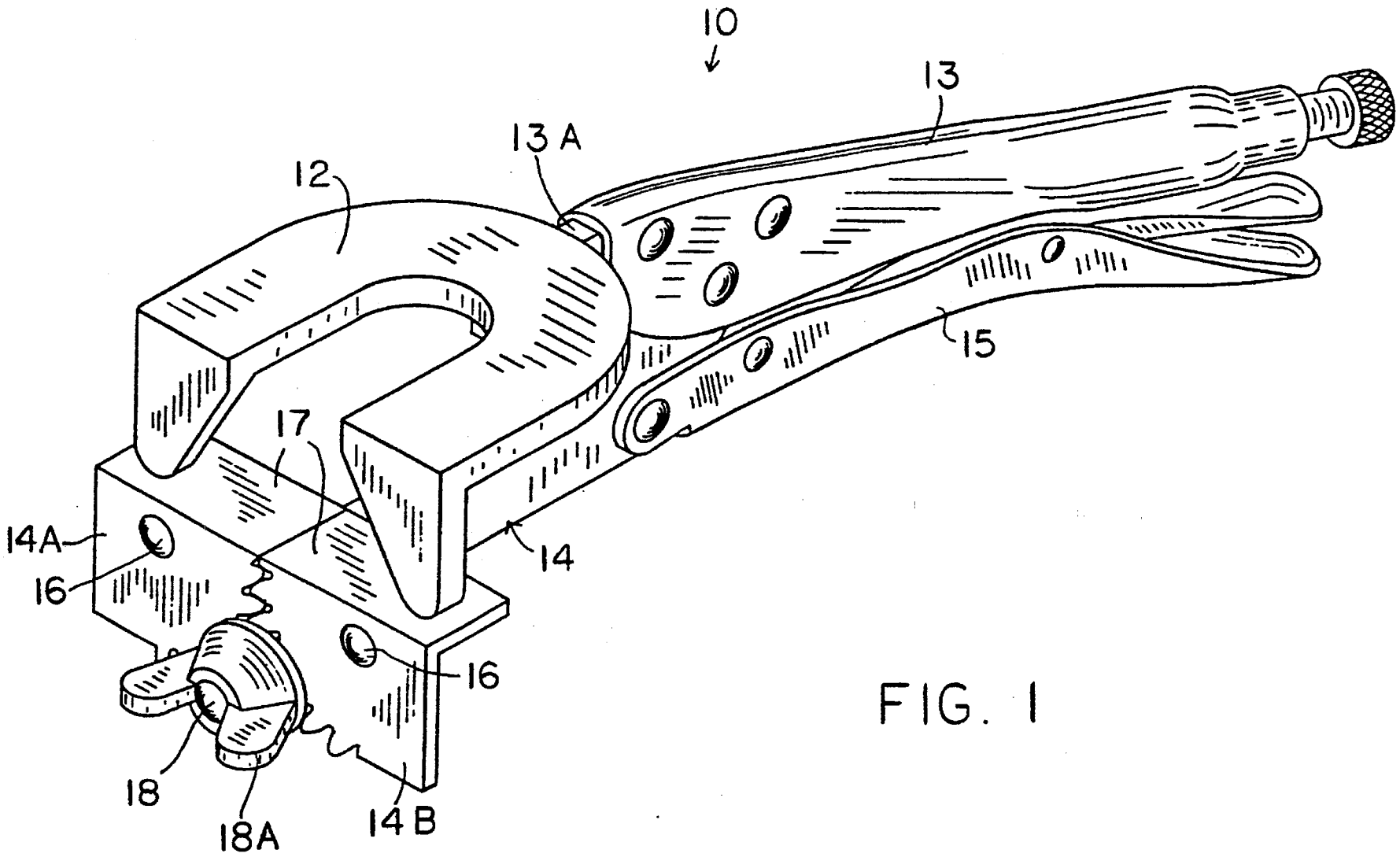
FIG. 1 is a perspective view of one embodiment of adjustable angle clamp of the invention.
Figure 2:
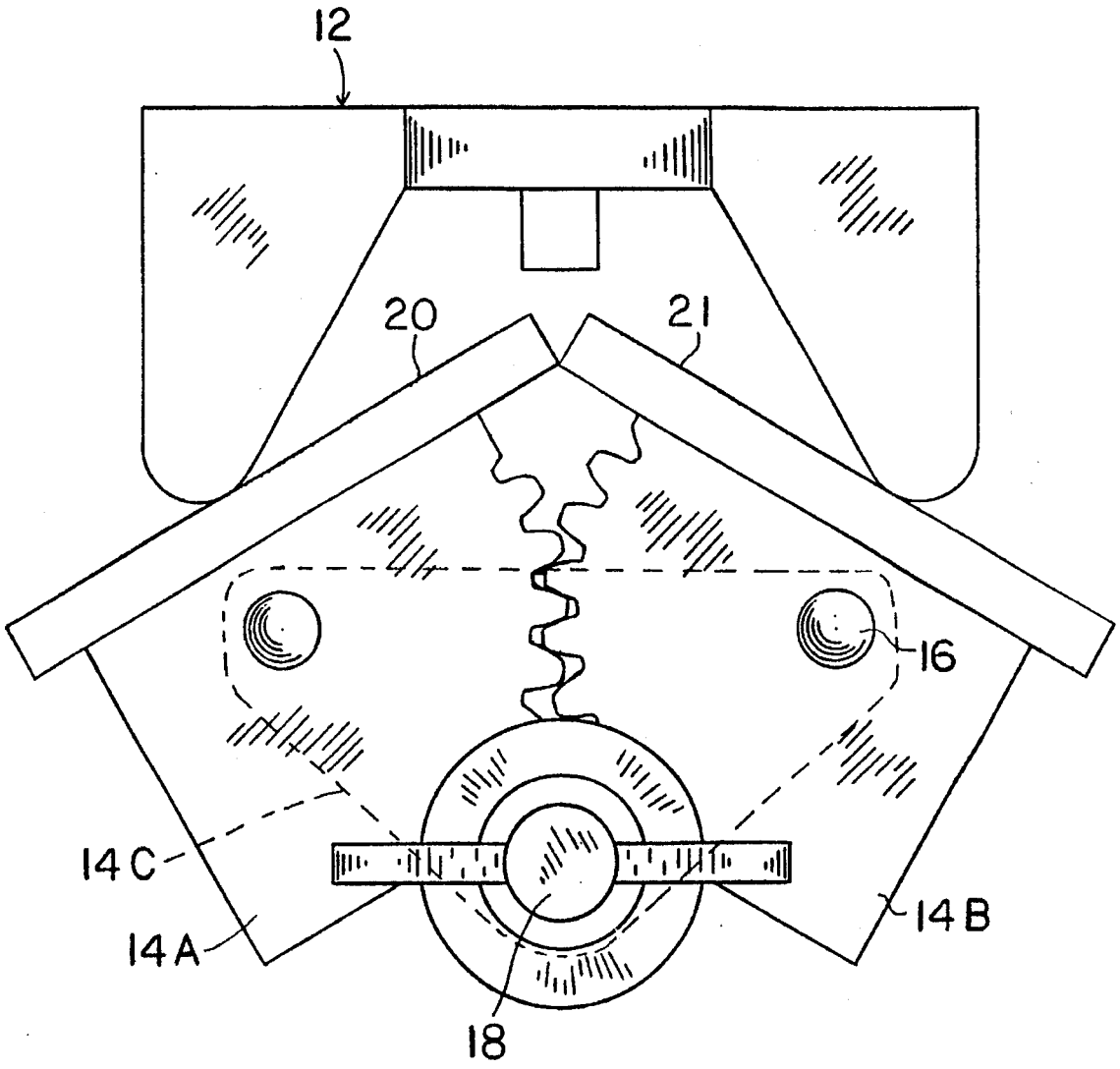
FIG. 2 is a front elevational view showing one manner in which the clamp of FIG. 1 is used to hold two workpieces together at angle.

In FIGS. 1 and 2 there is shown one embodiment of adjustable angle clamp 10 of the invention. The clamp includes a rigid U-shaped upper jaw 12 which is secured to the forward end 13A of one handle 13 and a lower jaw member which is carried by the forward end of the other handle 15. The lower jaw includes two jaw portions 14A and 14B which are each attached to the forward end 14C of jaw extension support member 14 by means of a pivot pin 16. The two jaw portions are meshed together by means of gear teeth on each portion, as shown. This arrangement results in simultaneous movement and adjustment of both jaw portions. Each jaw portion includes an upper face 17. After the jaw portions have been moved to achieve the desired angle between the two faces, the jaw portions can be locked or secured in a fixed position by bolt 18 and nut 18A.

FIG. 2 shows the lower jaw portions 14A and 14B at an angle to each other so as to support workpieces 20 and 21 at a desired angle to each other (e.g., so that the two pieces can be welded together).

The angle between the faces on the two jaw portions may be varied from 0° to about 120°, as desired.

The handle portion of the clamp is conventional and is used on various types of locking pliers. When the handles are moved apart from each other the jaws also move apart from each other. Conversely, when the handles are moved towards each other, the jaws also move towards each other. When the jaws clamp onto the desired object(s) and the handles are urged towards each other, the handles move to an over-center portion so that the clamp is locked in a closed position.

Figure 3:
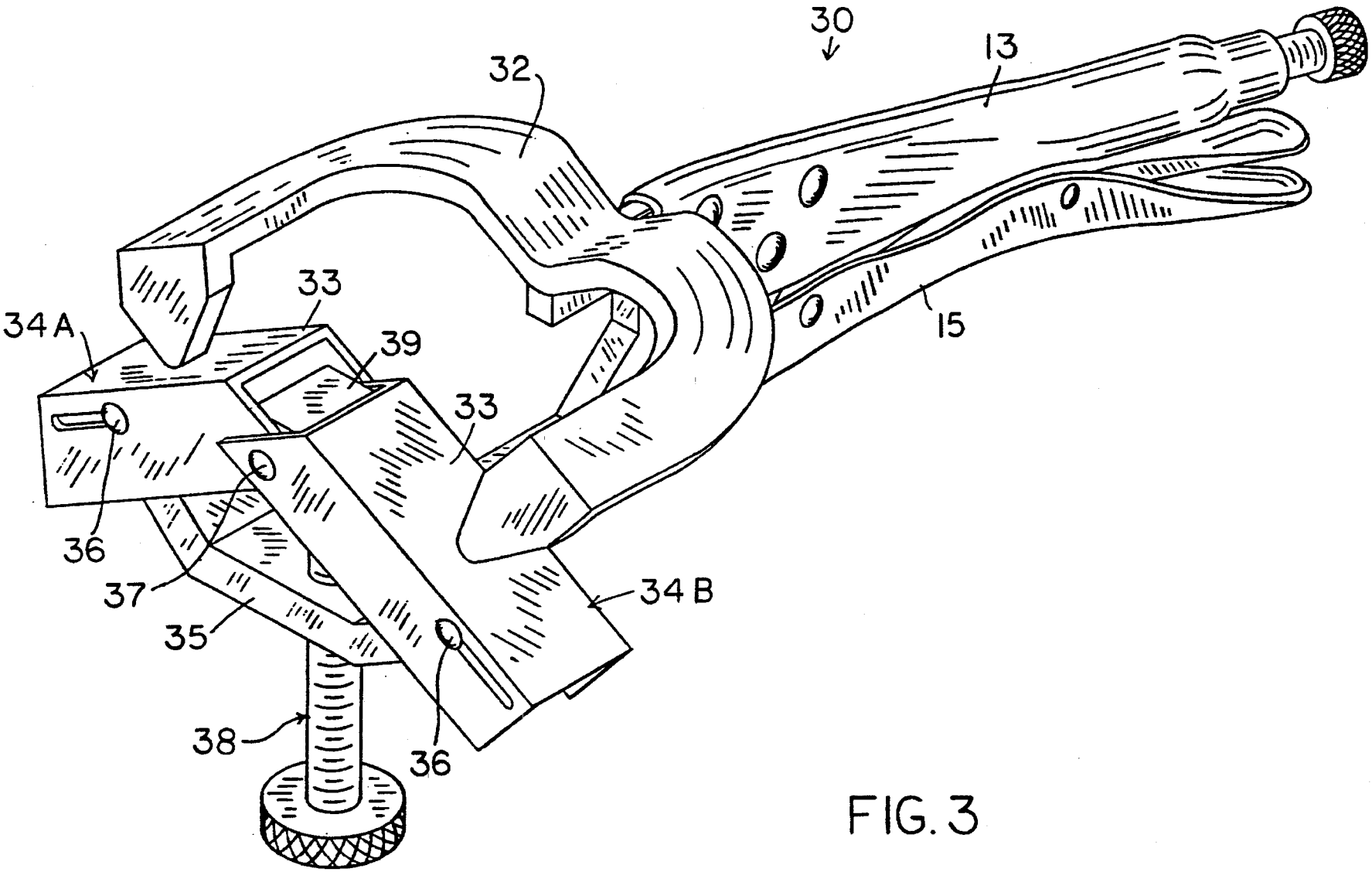
FIG. 3 is a perspective view of another embodiment of adjustable angle clamp of the invention.
Figure 3A:
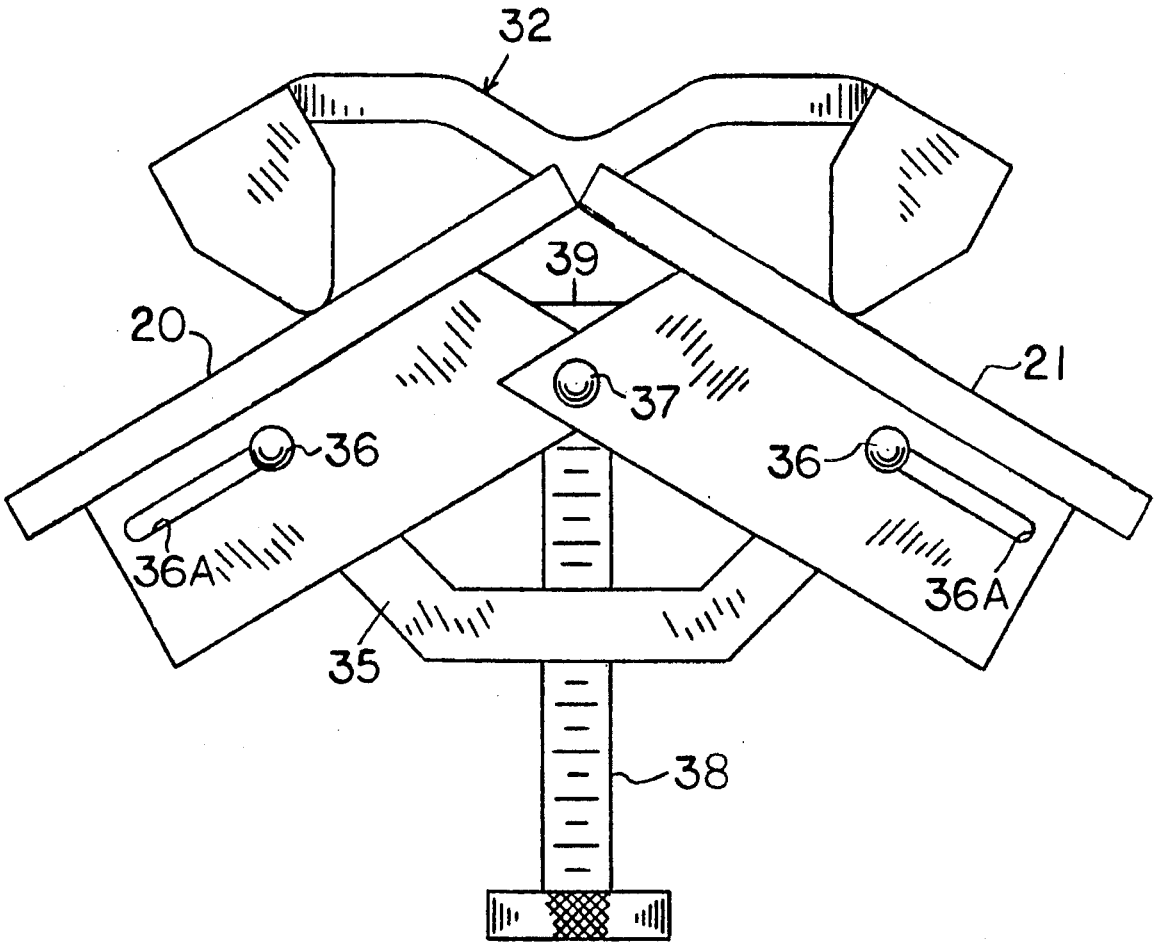
FIG. 3A is a front elevational view of the clamp of FIG. 3 holding two workpieces together at a desired angle.

FIGS. 3 and 3A illustrate another embodiment of adjustable angle clamp 30 comprising a rigid U-shaped upper jaw member 32 which is secured to one handle 13. The lower jaw member comprises two jaw portions 34A and 34B which are each pivotably attached to a jaw extension support member 35 by means of a pin 36 in slot 36A. The adjacent ends of jaw portions 34A and 34B are hingedly connected together by a pin 37.

The angle between the faces 33 of the two jaw portions can be changed very easily by means of screw 38 which is threadably carried by support member 35. One end 39 of the screw 38 is attached to pin 37 which is the pivot for jaw portions 34A and 34B. By rotating the screw to advance it through the support member 35, the screw forces the jaw portions to pivot relative to each other to thereby change the angle between the faces 33.

Figure 4:
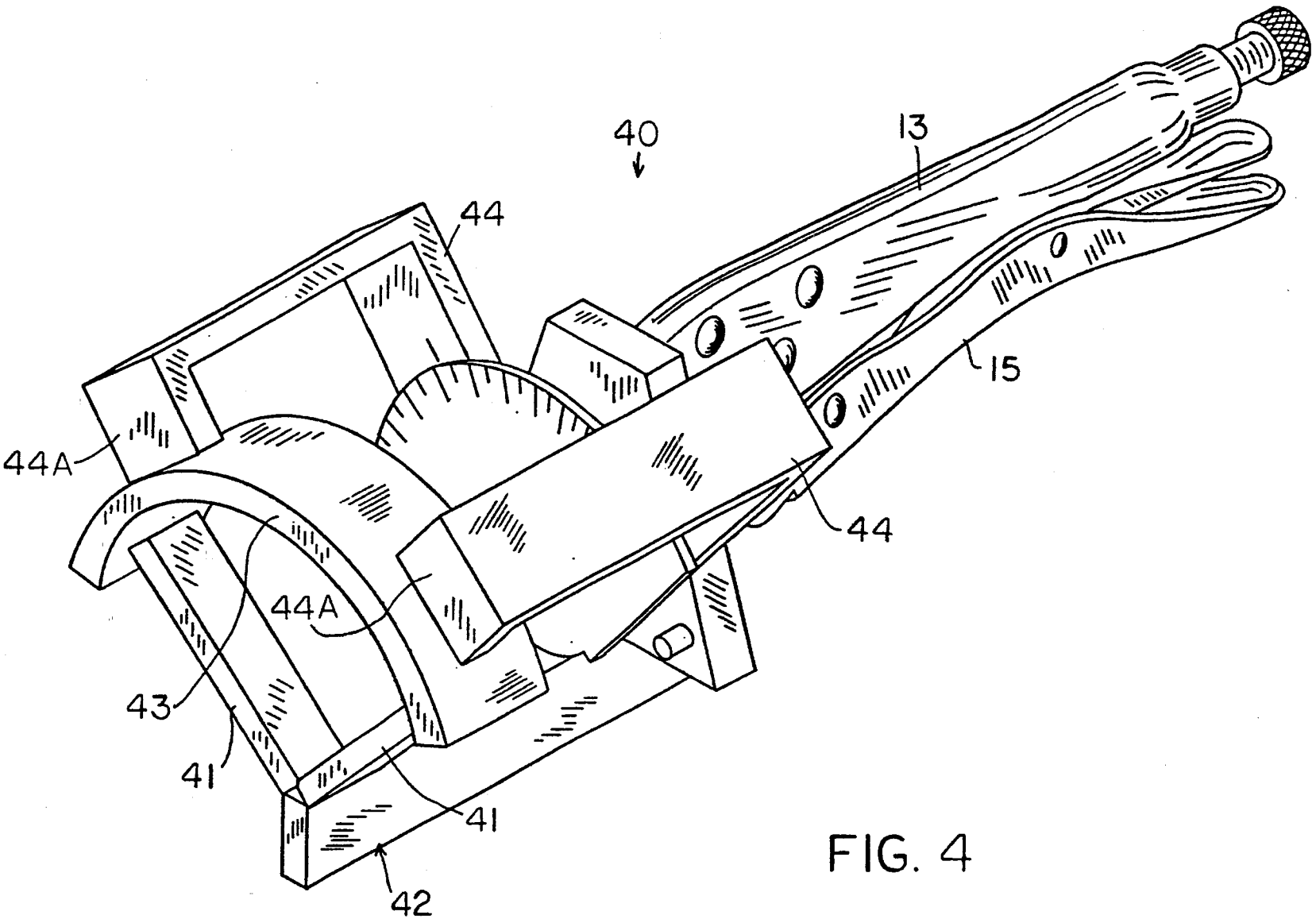
FIG. 4 is a perspective view of another embodiment of adjustable angle clamp of the invention.
Figure 4A:
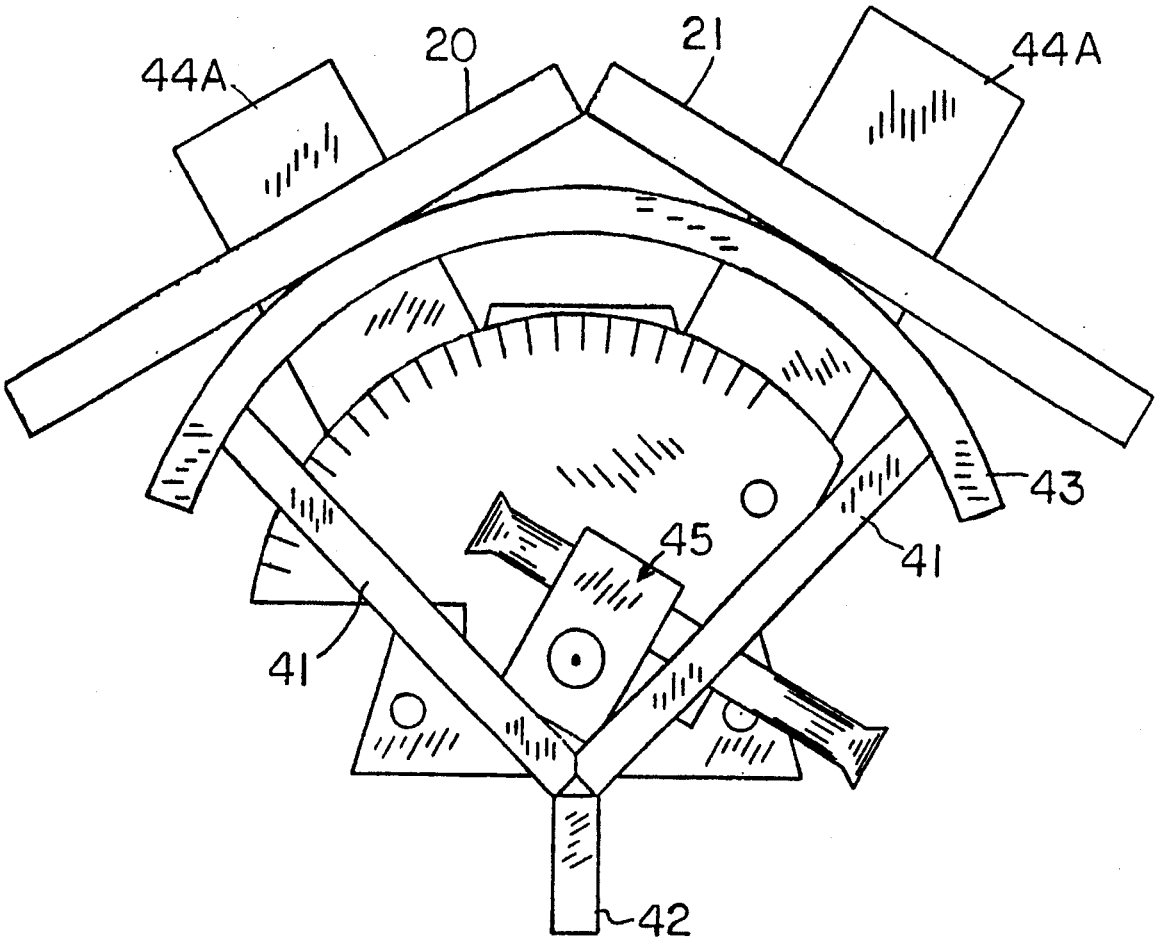
FIG. 4A is a front elevational view of the clamp of FIG. 4 holding two workpieces together at a desired angle.

Another embodiment of adjustable angle clamp 40 is shown in FIGS. 4 and 4A. In this embodiment there is a rigid lower jaw member 42 which is secured to one of the handle members. A curved portion 43 is supported by the lower jaw member by means of struts or braces 41. Two upper jaw members 44 are supported by and secured to the other handle member 13. Each jaw member includes a downwardly projecting portion 44A which projects toward the upper curved surface of the portion 43 of the lower jaw.

The upper jaw members 44 are mounted on a single pivot pin at their lower ends. As the upper jaw members are adjusted to the desired angle, they follow the arc of the curved portion of the lower jaw member. This arrangement allows for multi-angle adjustment.

The upper jaws are pivoted and adjusted by first loosening the pivot point hold down nut (or sliding bar nut) 45 and then moving the upper jaws by hand to the desired angle, after which the nut 45 is tightened.

Figure 5:
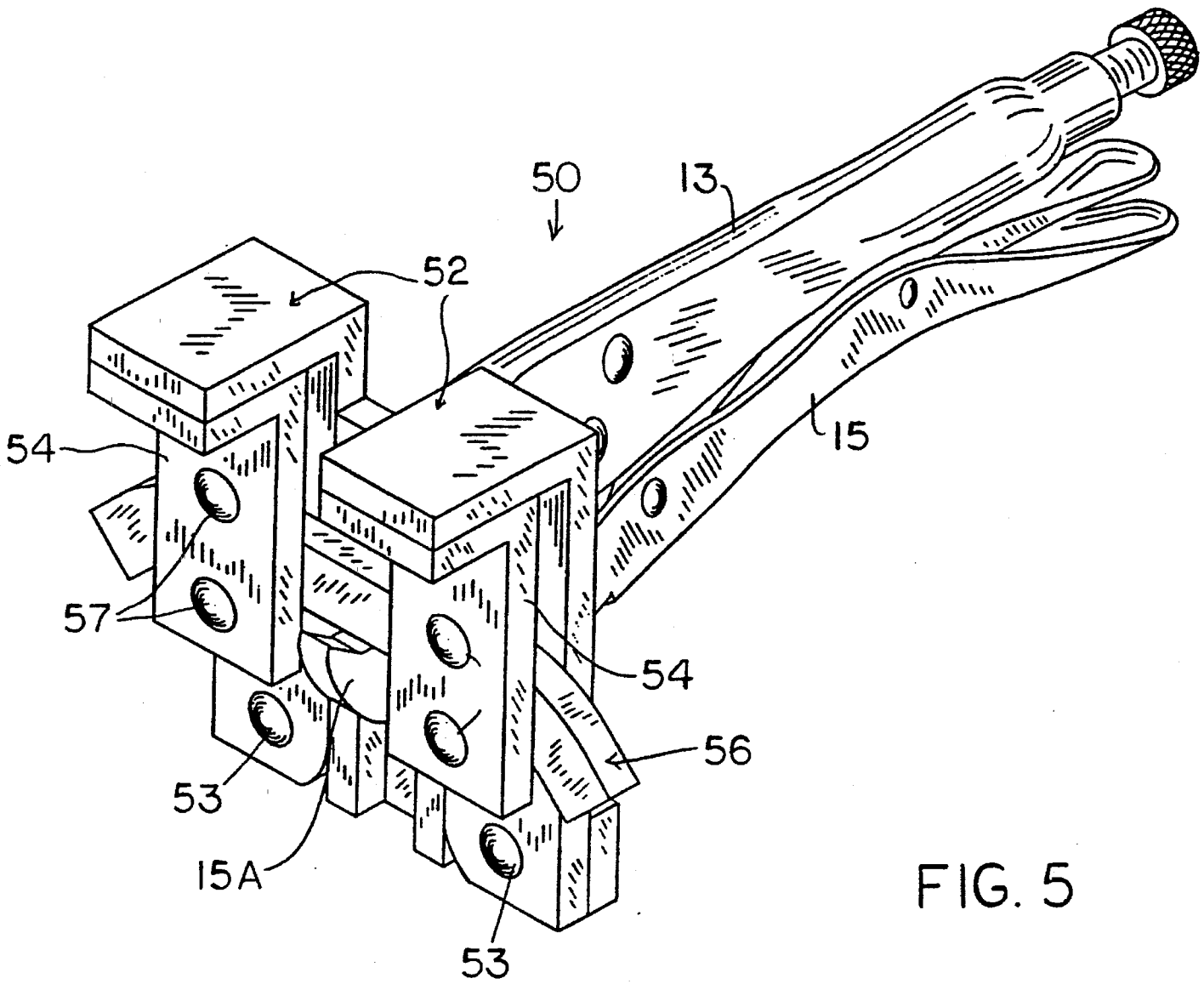
FIG. 5 is a perspective view of yet another embodiment of adjustable angle clamp of the invention.
Figure 6:
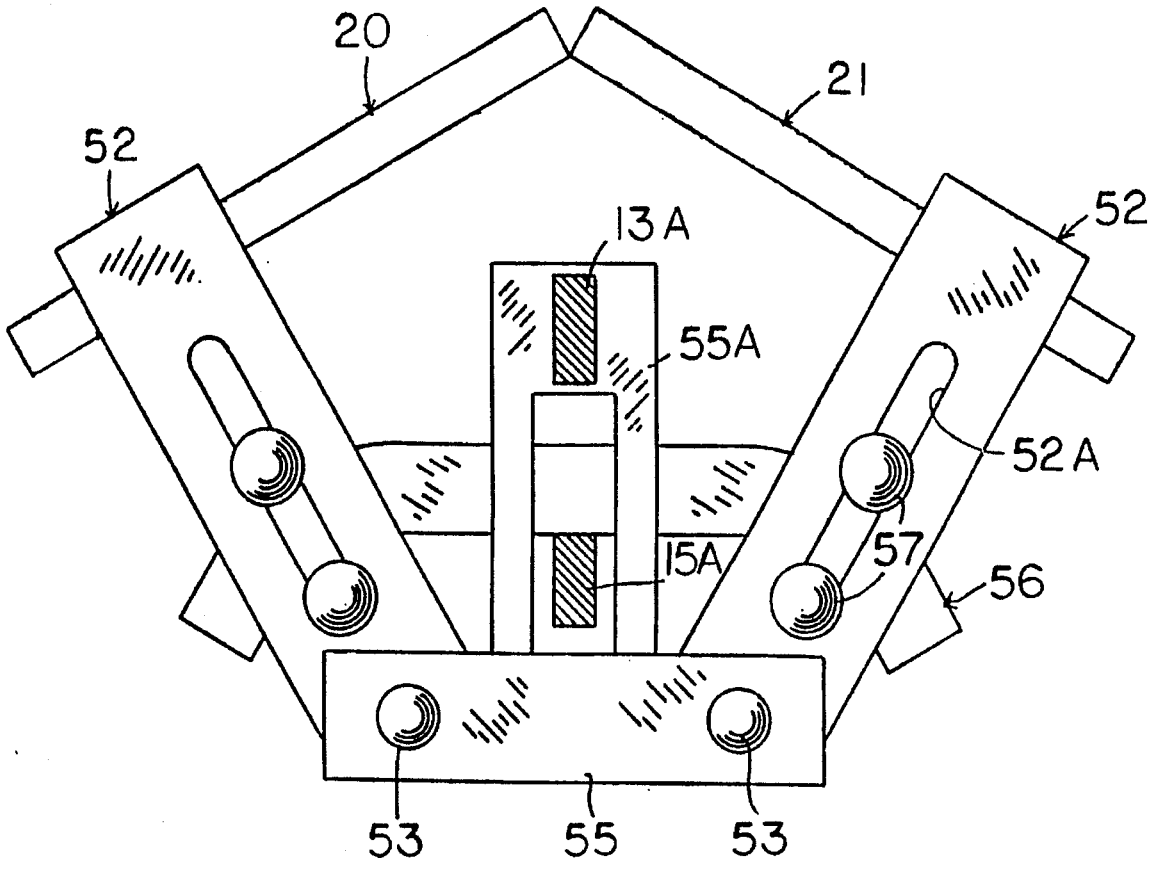
FIG. 6 is a rear view of the clamp of FIG. 5 showing the manner in which the clamp can support two workpieces at an angle.
Figure 7:
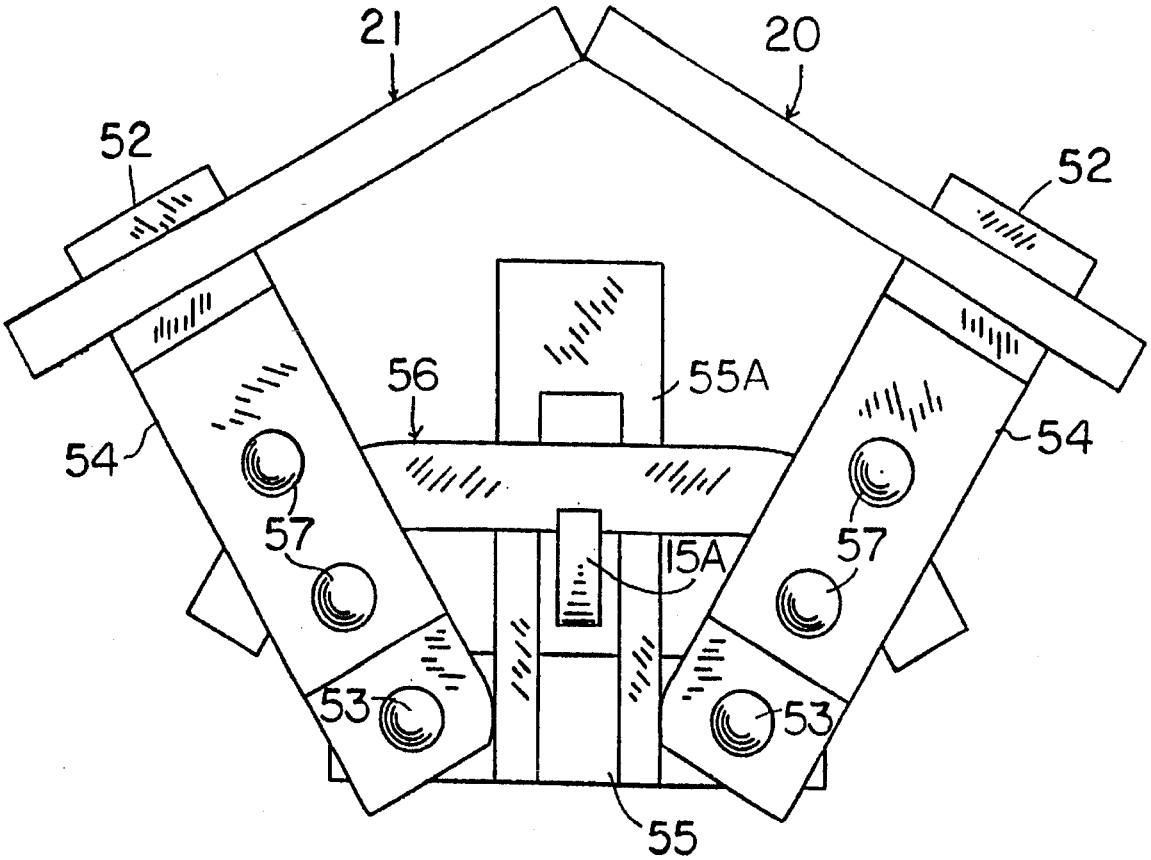
FIG. 7 is a front view of the clamp of FIG. 5.

FIG. 5 is a perspective view of another embodiment of angle-adjustable clamp 50 of the invention comprising two upper jaw members 52 and two lower jaw members 54. FIG. 6 is a rear view and FIG. 7 is a front elevational view of the clamp of FIG. 5 in which workpieces 20 and 21 are supported at an angle to each other. The upper jaw members are each attached to the lowermost pivot pin 53 on the main frame 55. Main frame 55 is attached to frame portion 55A secured to the forward end 13A of one of the handles 13. The lower jaw members are carried on a banana-shaped bar 56. Pins 57 above and below bar 56 extend through the lower jaw members 54 and also through slotted apertures 52A in upper jaw members 52. The bar 56 rests above the forward end 15A of handle 15. When the plier handles 13 and 15 are urged towards each other, the forward end 15A forces the bar 56 upwardly. This causes the lower jaw members 54 to be moved toward the upper jaw members 52 to clamp and support a workpiece between such jaw members.

The angle between the left and right jaw members may be changed or adjusted by rotating the jaw members about pivot pins 53. As the jaw members are rotated they follow the arc of the bar 56.

Figure 8:
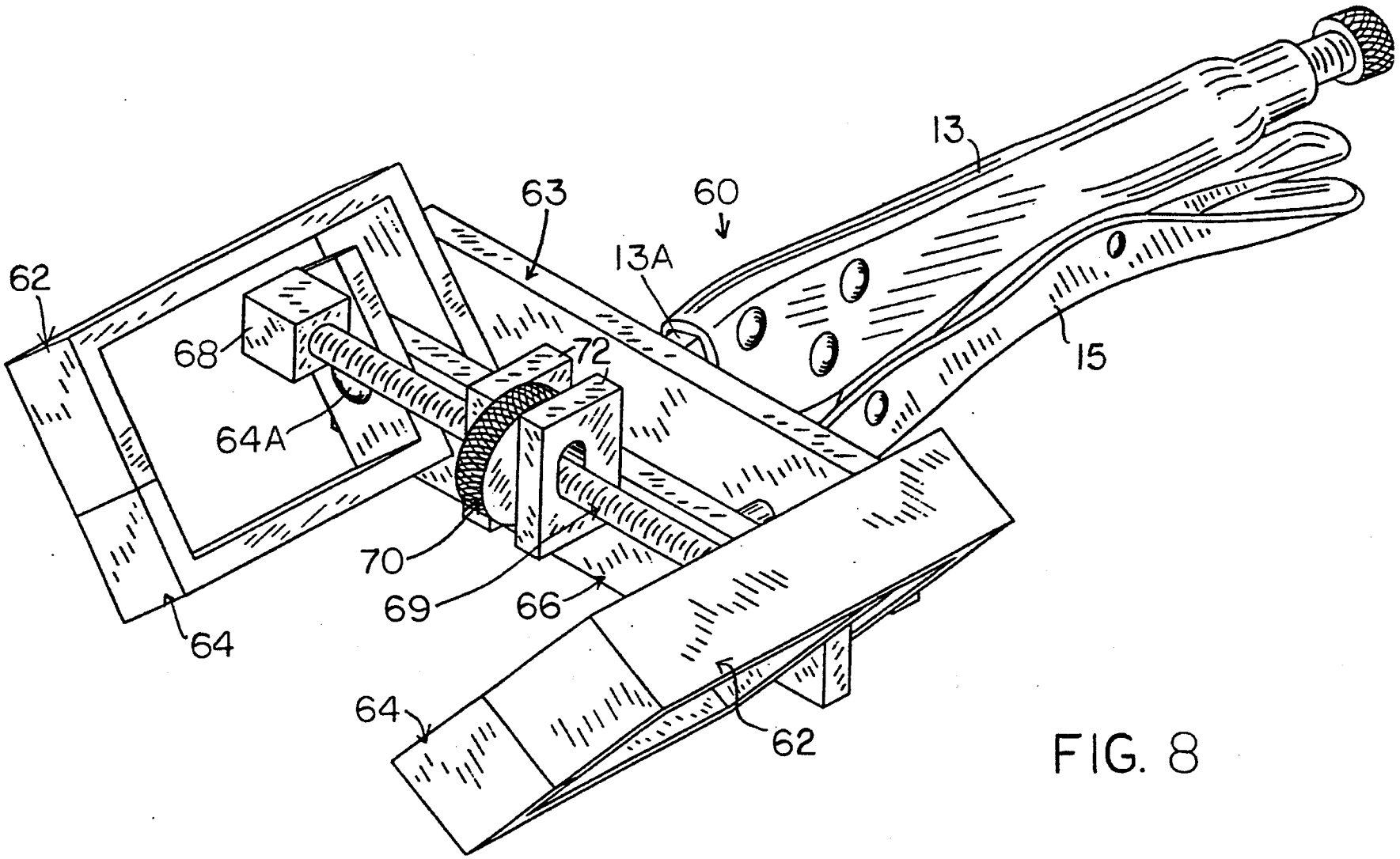
FIG. 8 is a perspective view of another embodiment of adjustable angle clamp of the invention.
Figure 9:
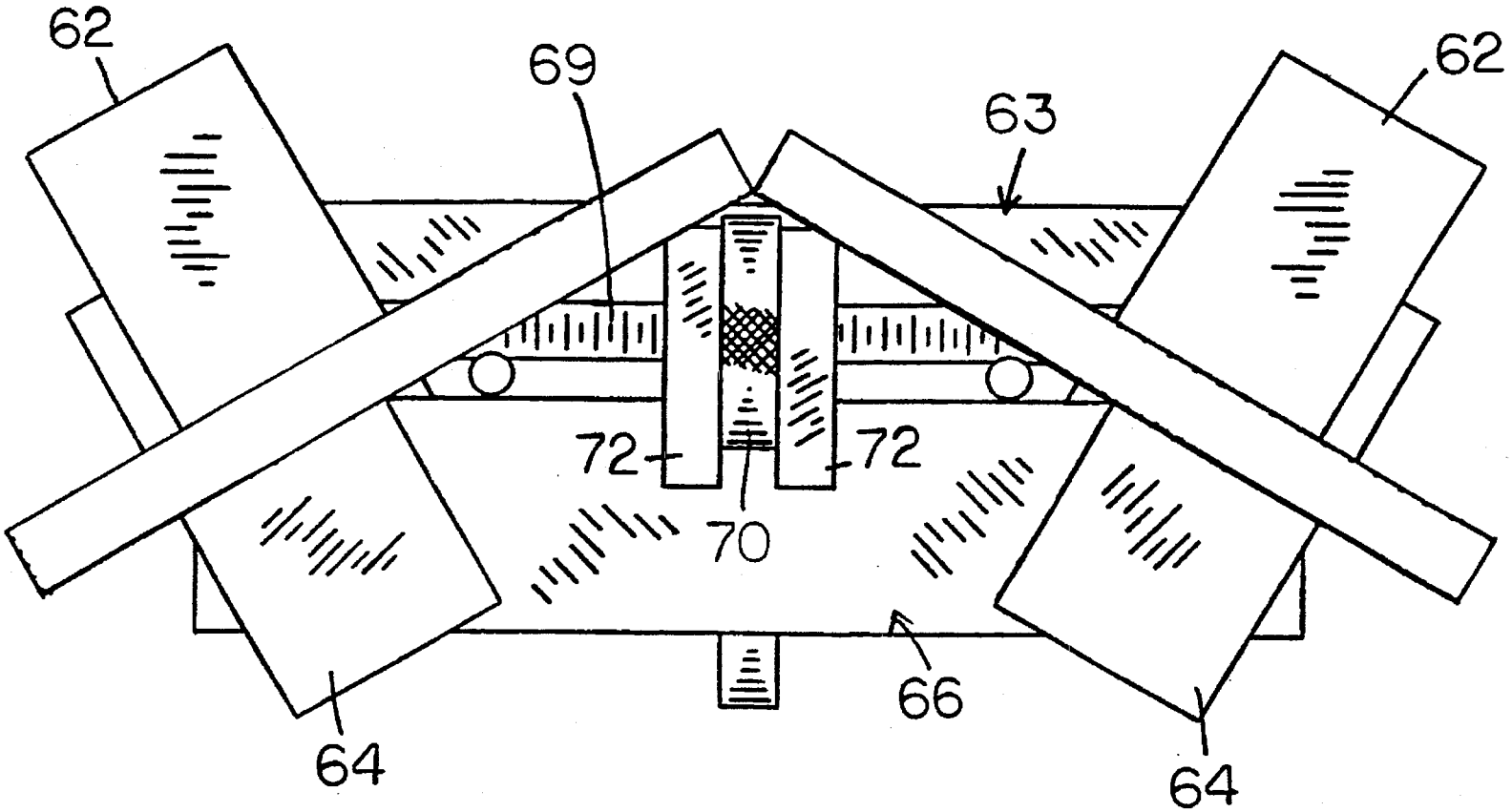
FIG. 9 is a front elevational view of the clamp of FIG. 8 holding two workpieces together at a desired angle.
Figure 10:
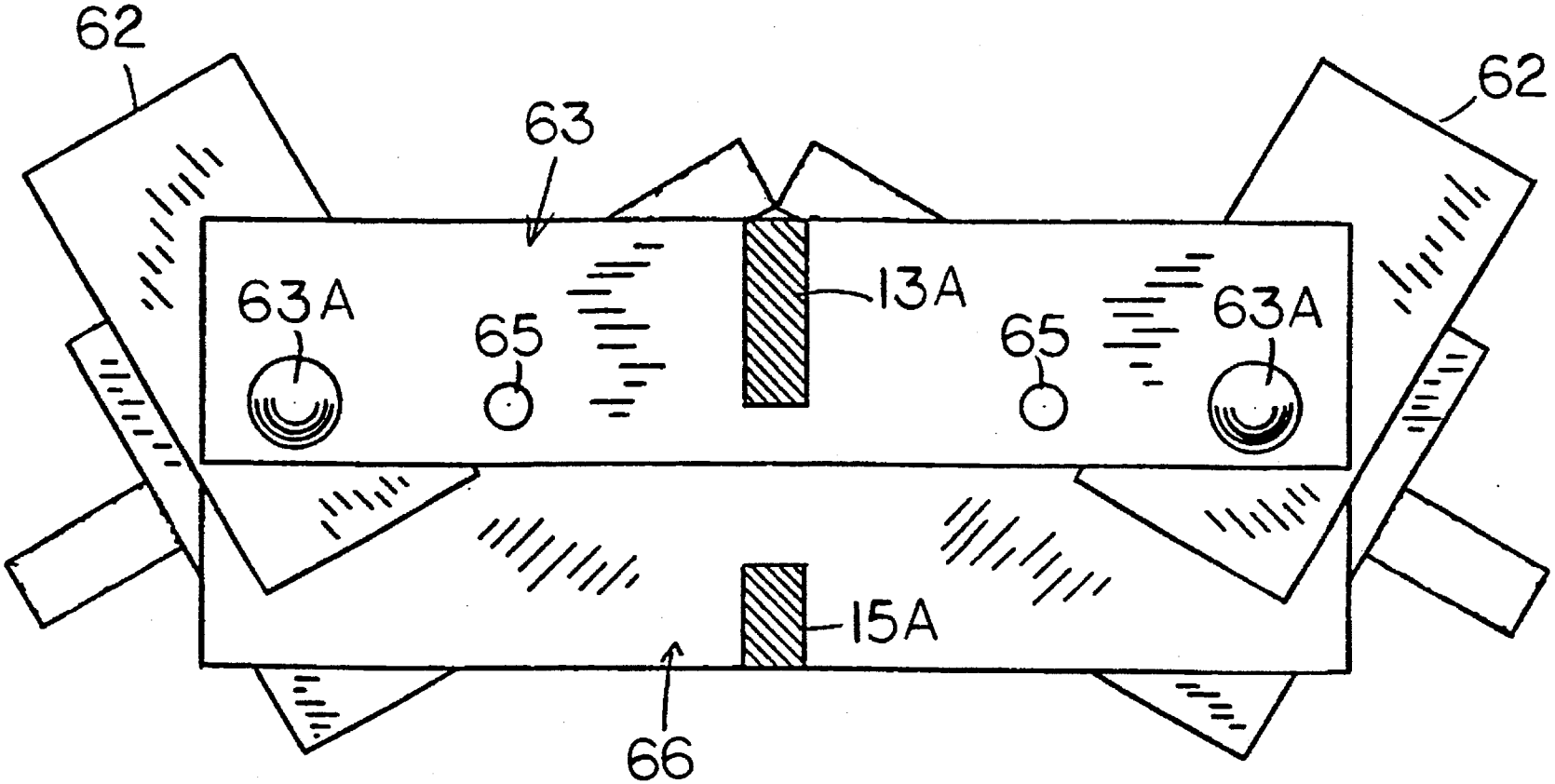
FIG. 10 is a rear elevational view of the clamp shown in FIG. 9.

FIG. 8 is a perspective view of another embodiment of adjustable angle clamp 60 of the invention. The clamp includes two upper jaw members 62 and two lower jaw members 64. FIG. 9 is a front view and FIG. 10 is a rear view.

The forward end 13A of handle 13 is secured to a perpendicular plate 63. Pins 63A extend through opposite ends of plate 63 and serve as attachment pivot points for upper jaw members 62. Inwardly from each pivot point 63A is a stop pin 65 to limit the rotation of the upper jaw members.

The forward end 15A of handle 15 is secured to a perpendicular plate 66. Plate 66 includes a pivot pin 64A in each end thereof for mounting each jaw 64 to plate 66.

Above pivot pin 64A on each jaw 64 there is mounted a swivel block 68 which includes a threaded aperture for a threaded shaft 69 (which has a left-hand thread on one end and a right-hand thread on the other end). An adjusting wheel 70 is fixed at the center of the shaft 69 between spaced-apart plates or blocks 72 secured to plate 66. Thus, when the wheel is rotated in one direction the blocks 68 move in opposite directions, and when the wheel is rotated in the opposite direction the blocks 68 move towards each other. This arrangement causes the jaw members to be pivoted to the desired position.

Other variants are possible without departing from the scope of the invention.

What is claimed is:

1. An adjustable clamp comprising:

(a) a handle portion;

(b) a clamp portion connected to said handle portion; wherein said clamping portion comprises first and second jaw members; wherein at least one of said jaw members includes first and second faces; wherein the angle between said faces is adjustable; wherein the other of said jaw members comprises a curved member which defines an arc; and wherein said first and second jaw members are movable by said handle portion between open and closed positions.

2. A clamp in accordance with claim 1, wherein said handle portion comprises a plurality of pivotally related members.

3. A clamp in accordance with claim 2, wherein said pivotally related members comprise first and second handle members and a pivot arm pivotally attached to said handle members; wherein said first jaw member is secured to said first handle member and second jaw member is secured to said second handle member.

4. A clamp in accordance with claim 3, wherein the angle between said first and second faces is adjustable from 0° to 120°.

5. A clamp in accordance with claim 3, wherein first and second faces are carried by first and second support members; wherein said support members are pivotally connected to each other.

6. A clamp in accordance with claim 1, wherein said first jaw member comprises first and second jaw portions which are pivotally supported by said handle portion; and wherein said first and second faces are located on said first and second jaw portions respectively,

7. A clamp in accordance with claim 6, further comprising a hold down nut for locking said jaw portions in a desired position.

8. A clamp in accordance with claim 1, further comprising brace members attached to said curved member.

* * * * *